US005308958A

United States Patent [19]

Gassho

[11] Patent Number: 5,308,958

[45] Date of Patent: May 3, 1994

[54] CIRCUIT FOR CONTROLLING ENERGIZING OF HEATING ELEMENTS

[75] Inventor: Kazuhito Gassho, Nagano, Japan

[73] Assignee: Seiko Epson Corporation, Tokyo, Japan

[21] Appl. No.: 875,398

[22] Filed: Apr. 29, 1992

[30] Foreign Application Priority Data

May 9, 1991 [JP] Japan ..... 3-104257
Feb. 24, 1992 [JP] Japan ..... 4-036612

[51] Int. Cl.[5] ..... H05B 1/02

[52] U.S. Cl. ..... 219/486; 219/216; 219/485; 219/506; 346/76 PH; 307/39

[58] Field of Search ..... 219/216, 483, 486, 485, 219/507, 506; 346/76 PH, 140 R, 141; 307/38-41

[56] References Cited

U.S. PATENT DOCUMENTS 4,176,272 11/1979 Powes ..... 219/216 PH
4,556,891 12/1985 Matsushita et al. ..... 346/76 PH
4,996,487 2/1991 McSparrao et al. ..... 219/216 PH

FOREIGN PATENT DOCUMENTS 59-111872 6/1984 Japan .
60-44372 3/1985 Japan .
60-154772 8/1985 Japan .
63-72561 4/1988 Japan .
1-192561 8/1989 Japan .

*Primary Examiner*—Mark H. Paschall
*Attorney, Agent, or Firm*—Sughrue, Mion, Zinn, Macpeak & Seas

[57] ABSTRACT

A circuit for controlling the energizing of heating elements (13), including transistors (12) for controlling the energizing of the respective heating elements, energizing start time counter circuits (22) for determining a delay time until the energizing of the respective transistors (12) is started, and energizing time counter circuits (23) for determining energizing time. Data are written to the respective counter circuits from the outside via a group of multi-bit, multi-stage latch circuits and a counter clock signal (8). The energizing start time counter circuits (22) are collectively and simultaneously caused to perform a count (subtraction) operation. Then, the energizing time counter circuit (23) is made to start a count operation at a point in time when each of the energizing start time counter circuits (22) holds a value of 0, and the transistors (12) start to energize each heating element (13). According to this arrangement, dots are formed at equal horizontal intervals, irrespective of the dot size.

4 Claims, 7 Drawing Sheets

CIRCUIT FOR CONTROLLING ENERGIZING OF HEATING ELEMENTS

BACKGROUND OF THE INVENTION

The present invention relates to control of a thermal head of a thermal printer, and more particularly, to a circuit for controlling the area modulation of a transfer pixel unit.

FIG. 9 illustrates a conventional circuit for controlling the energizing of heating elements. In FIG. 9, numeral 101 denotes heating elements, 108 transistors for driving the respective heating elements, 107 AND gates, 106 latches, 104 a shift register, 109 an energizing time signal line, and 102 a printing data line through which one-bit printing data is input on a time series basis, the printing data being transferred to the shift register 104 in synchronization with a clock signal from a transfer clock line 103. After all the printing data for turning on or off the heating elements 101 have been transferred, a latch signal from a latch signal line 105 causes the printing data stored in the shift register 104 to be collectively stored in the respective latches 106. Before being converted into a signal for driving the transistor 108, the output of the latch 106 is input to one terminal of AND gate 107, while a signal from the energizing time signal line 109 is input to the other terminal of AND gate 107. The heating element 101 is energized via the transistor 108 by making the printing data "1" (HIGH), while the heating element is energized only for the period of time defined by the energizing time signal after the printing data is completely stored in the latch 106. With this arrangement, the energizing time can be varied by supplying to each heating element the number of pulses corresponding to image density, where 256 dots in terms of a binary data image is equivalent to one line. For example, the energizing time can be varied with respect to a maximum dot of one pixel in a multi-value data image when tone is emphasized, by individually controlling the heating-element energizing time as in the case of a multi-value data image, or when energizing time control at a level of 256 is exercised on the individual heating element.

As described above, the energizing of one heating unit is determined by the time required for data to be transferred to the register in view of the prior art circuit configuration. If it is attempted to control the energizing time to increase the image density, the printing speed per line tends to decrease. In other words, simultaneous control of printing speed and energizing time has heretofore been incompatible. In order to solve this problem, there has been proposed a method of controlling the energizing time by transferring energizing time data to a multi-bit shift register and inputting the data to a counter with a latch function to allow individual control of the energizing times of the heating elements. Although simultaneous control of printing speed and energizing time has been made compatible in the method described above, the center of a dot shifts in proportion to its diameter ($\Delta L$), as shown in the transfer pixel configuration of FIG. 10. The disadvantage in this case is that the dot corresponding to the pixel tends to be inclined, although at a small angle.

SUMMARY OF THE INVENTION

In view of the foregoing problems, an object of the present invention is to provide a circuit for controlling the energizing of heating elements in such a way as to obtain uniformity of the visual pixel arrangement while making compatible the control of multi-value data image printing speed and energizing time.

In order to solve the problems stated above, a circuit for controlling the energizing of heating elements according to the present invention comprises transistors for respectively turning on or off a plurality of heating elements aligned on a thermal head, latch circuits of multi-bit construction for storing energizing time values, energizing time counter circuits for counting the energizing time values stored in the o latch circuits, and energizing start time counter circuits for controlling time periods until the energizing time counter circuits start the timing operation, wherein a value is input to the energizing start time counter circuit, the value being given by subtracting $\frac{1}{2}$ of an energizing time value of a dot to be printed from $\frac{1}{2}$ of the maximum printable energizing time.

The output of the energizing start time counter is used to energize the heating element, and suspends the energizing of the heating element after the heating element has been energized for a period of time determined by the energizing time counter.

DESCRIPTION OF THE PREFERRED EMBODIMENTS

Figure 1:
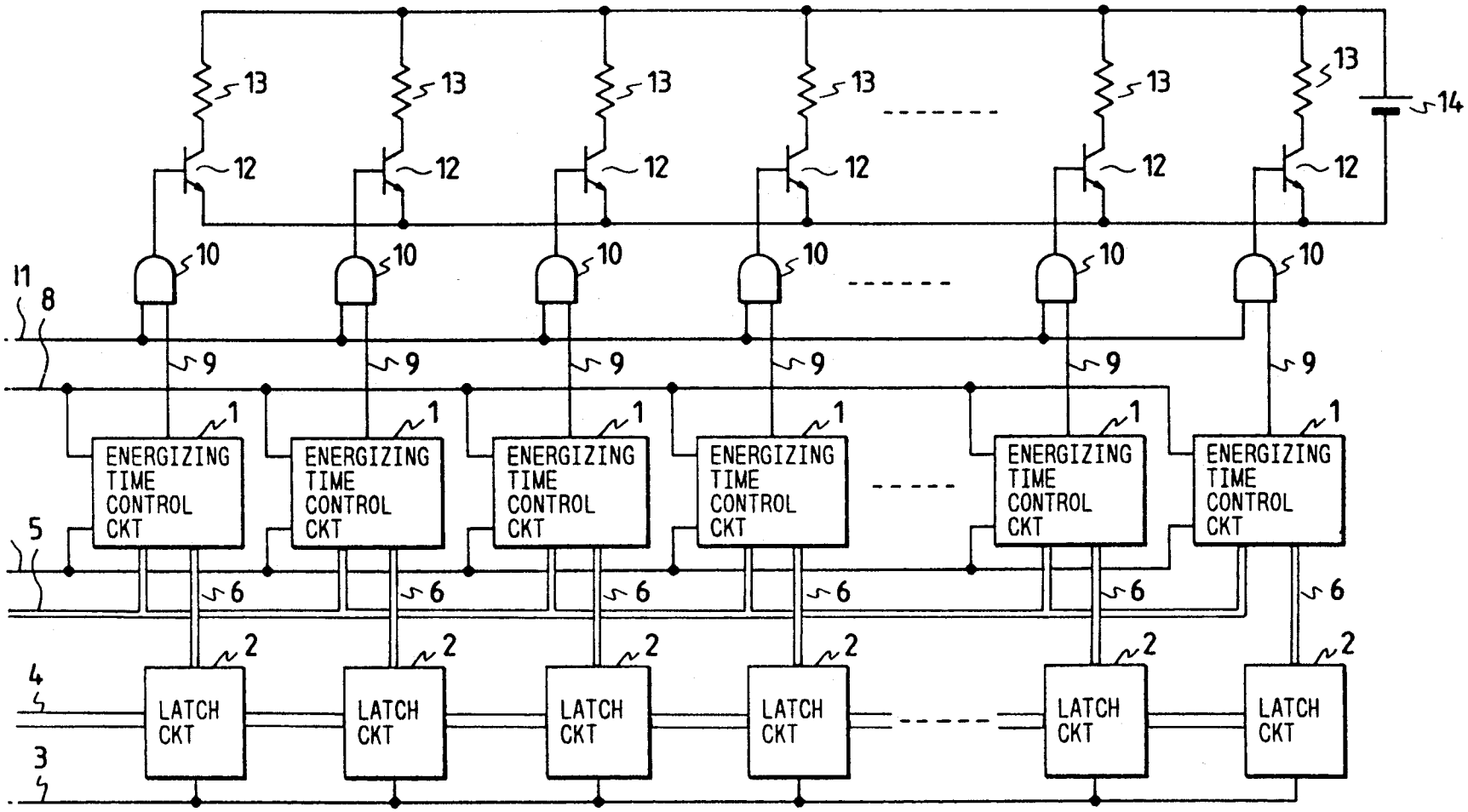
FIG. 1 is a block diagram illustrating a circuit for controlling the energizing of heating elements according to a first embodiment of the present invention.
Figure 3:
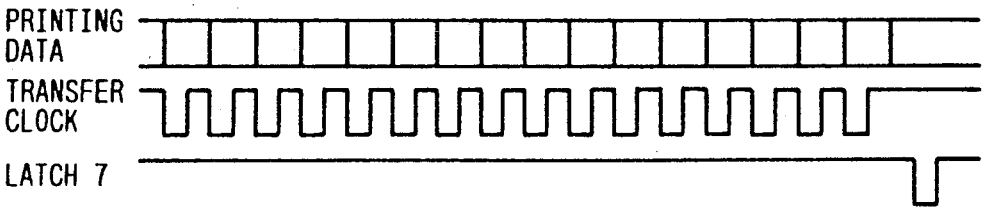
FIG. 3 is a timing chart illustrating printing data transfer operation timing.

FIG. 1 is a block diagram illustrating a circuit for controlling the energizing of heating elements constructed according to a first embodiment of the present invention. In FIG. 1, reference numeral 2 denotes multi-bit latch circuits corresponding in number to heating elements 13, each of which is of multi-stage construction so that an output at the preceding stage is made an input at the following stage, and 3 a transfer clock signal line, this signal line being connected to all the latch circuits 2. When the same number of printing data as that of heating elements 13 is input, via a printing data line 4, to the latch circuit 2 in synchronization with the transfer clock 3, each latch circuit 2 is made to store printing data. (See FIG. 3 for timing).

A latch circuit output line 6, as an output of each latch circuit 2, is connected to an energizing time control circuit 1, as will be described later. The number of the energizing time control circuits corresponds in number to that of heating elements 13 to be energized.

Figure 2:
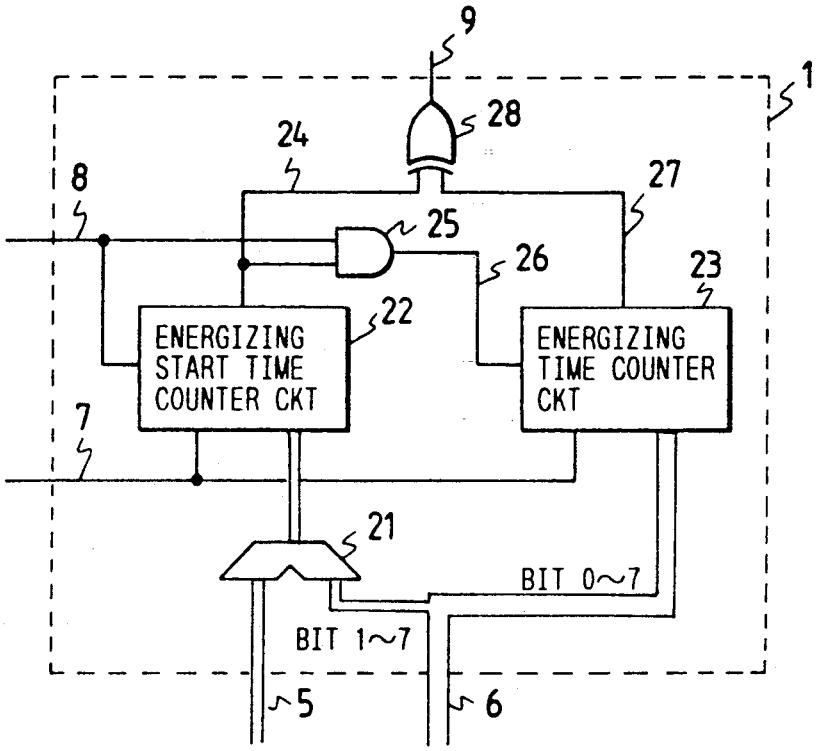
FIG. 2 is a block diagram illustrating in detail the energizing time control circuit in the first embodiment.

FIG. 2 illustrates an energizing time control circuit 1 embodying the present invention, wherein the latch circuit output line 6, described above, is connected to the input of an energizing time counter circuit 23 and a subtraction circuit 21. The latch circuit output line 6 and the subtraction circuit 21 are connected in such a way that both of them are shifted by one bit to ignore the least significant bit (BITO) of the output of the latch circuit, and that a secondary bit in priority is made the least significant bit as an input to the subtraction circuit 21. The relationship of the input value of the subtraction circuit 21 and the output value of the latch circuit 2 can be defined such that an input value of the subtraction circuit 21 is equal to ½ of an output value of the latch circuit 2.

In contrast to the bit configuration of the latch circuit 2, the subtraction circuit 21 is configured such that the number of bits is one less than that of the latch circuit 2, or 0 has been input to what is higher in order than an effective bit of the subtraction circuit 21.

The output of a maximum energizing time register that has stored a value signifying ½ of the energizable maximum time (not shown) is input to one input terminal of the subtraction circuit 21 at all times. As a result, the subtraction circuit 21 outputs ½ of maximum energizing time minus ½ of the output value of the latch circuit when the output value of the latch circuit 2 is input thereto.

Moreover, the output of the subtraction circuit 21 is connected to the input of an energizing start time counter circuit 22.

The energizing start time counter circuit 22 and the energizing time counter circuit 23 are connected to a latch signal line 7, and the output of the subtraction circuit 21 is stored in the former, whereas the output value of the latch circuit 2 is stored in the latter.

The energizing start time counter circuit 22 and the energizing time counter circuit 23 automatically stop operation when their internal count becomes 0 by producing outputs equal to "1" (HIGH). With the count initially set at 0, the counters do not operate until data other than 0 is written in response to the latch signal. Moreover, the energizing start time counter circuit 22 receives a count clock signal from a count clock signal line 8 for counting down the count. The count clock signal directed to the energizing time counter circuit 23 is generated by the output of AND gate 25 which is supplied with a signal from the output line 24 of the energizing start time counter circuit 22 and a count clock signal.

Further, an energizing time signal, output from an exclusive-OR gate 28 supplied with signals from the output line 24 of the energizing time counter circuit 22 and the output line 27 of the energizing time counter circuit 23, is generated on an energizing time signal line 9. This energizing time signal is input to an AND gate 10 for protecting a transistor 12, and the other input of the AND gate is supplied with a protective gate signal from a signal line 11 for use in inhibiting the energizing of heating element 13. The output signal from the AND gate is then used as a drive signal of the transistor 12 for driving the heating element 13.

Referring to the timing chart of FIG. 4, a description will next be given of the operation of the control circuit thus arranged by way of an example wherein the printing data value is set at 96 and the energizable maximum time is set at 256.

Since the energizable maximum time has been set at 256, 128 in value (256/2=128) is input to one end of the input line 5 of the subtraction circuit 21, whereas 48 (96/2=48) is input to the other. The subtraction circuit 21 therefore outputs 80 in value (128−48=80).

An input from the latch signal line 7 causes the output value (80) of the subtraction circuit 21 to be written to the energizing start time counter circuit 22. Consequently, the output line 24 changes to "0" (LOW) and the energizing start time counter circuit 22 starts the count operation in synchronization with the counter clock signal 8. Simultaneously, an input from the latch signal line 7 causes the printing data value (96) to be written to the energizing time counter circuit 23 and the output 27 changes to "0" (LOW). Consequently, the AND gate 25 is placed in a closed state and the counter clock signal 8 is not supplied to the energizing time counter circuit 23, which does not perform the count operation. (FIG. 4, T0−T1).

Figure 4:
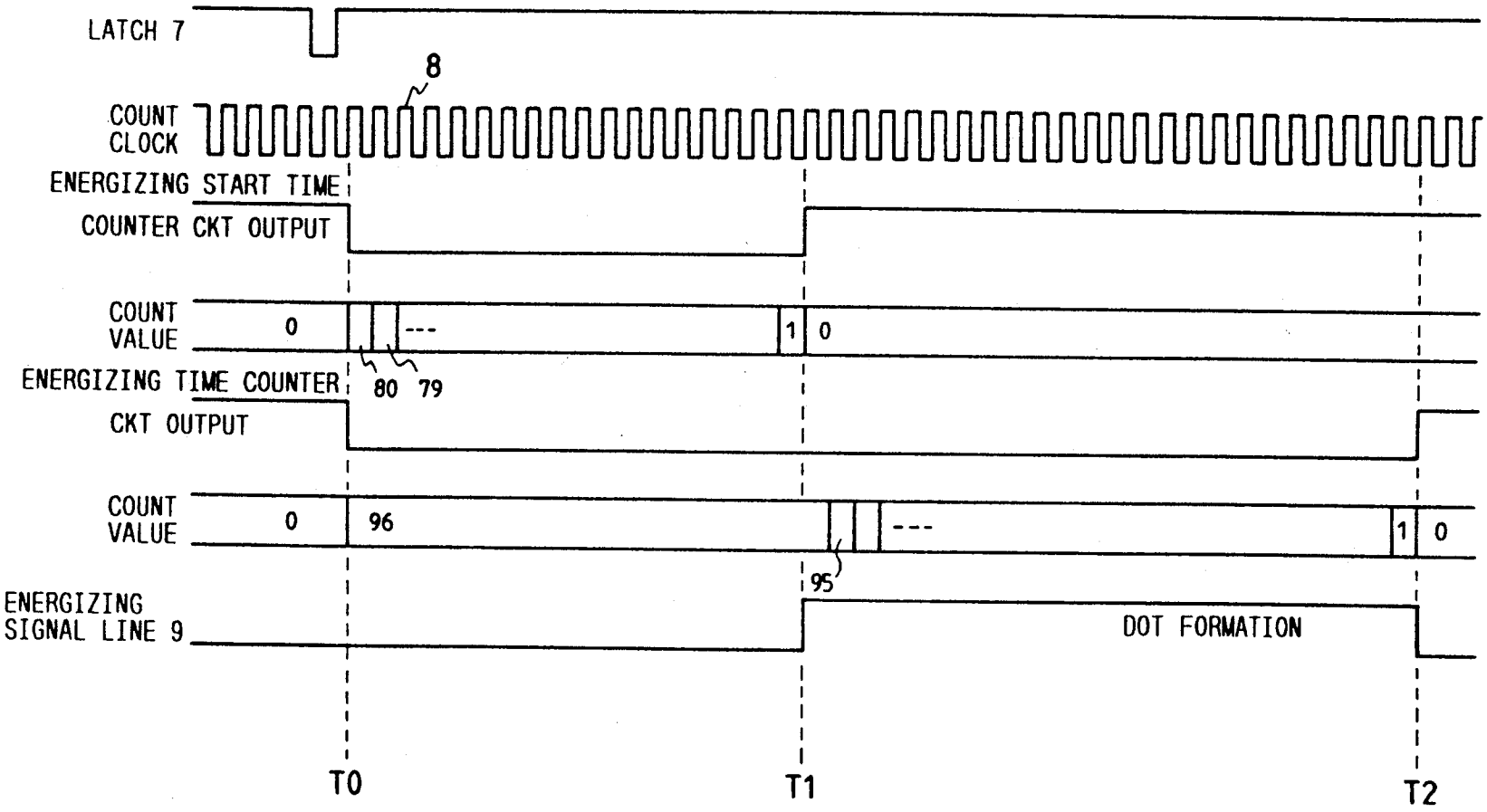
FIG. 4 is a timing chart illustrating heating element energizing operation timing in the first embodiment.
Figure 5:
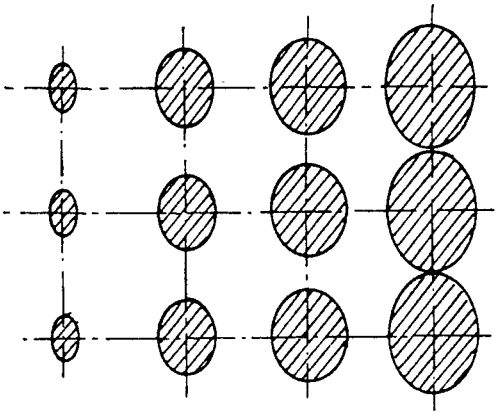
FIG. 5 is a diagram illustrating a situation in which pixels obtained from the first embodiment are formed.
Figure 8:
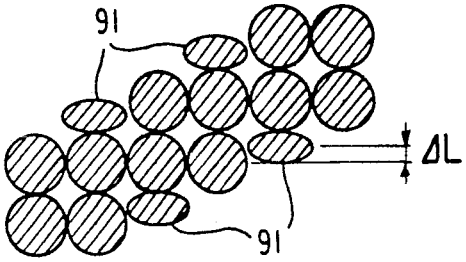
FIG. 8 is a diagram illustrating a situation in which pixels obtained from the second embodiment are formed.
Figure 10:
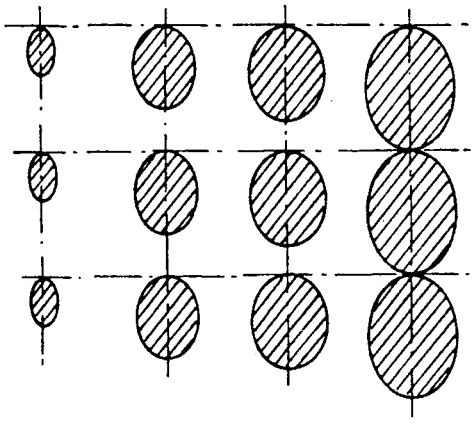
FIG. 10 is a diagram illustrating pixels obtained from the conventional circuit for controlling the energizing of heating elements.
Figure 11:
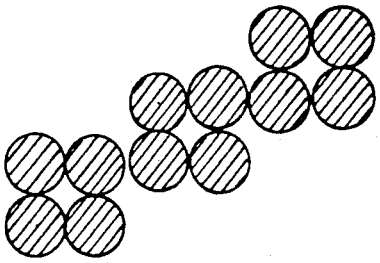
FIG. 11 is a diagram illustrating pixels obtained from the conventional circuit for controlling the energizing of heating elements when slanted lines are drawn.

When the count of the energizing time counter circuit 23 changes to 0 after energizing is carried out for a period of time corresponding to the dot size to be thus formed, the output 27 changes to "0" (LOW) and the energizing time counter circuit 23 stops the count operation (FIG. 4, T2). Then, the D energizing signal also stops dot formation. In other words, as the output obtained by the XOR gate 28, supplied with the output 24 of the energizing start time counter circuit 22 and the output 27 of the energizing time counter circuit 23, is supplied to the energizing signal line 9, "1" (HIGH) is held between T1−T2 of FIG. 4 and the transistor 12 is driven via the AND gate 10. The heating element 13 is thus energized. As a result, the position of the dot formation is shifted in such a way that it centers around the center of a maximum diameter dot, irrespective of the diameter of the dot to be formed, and intermediate points in the energizing state are lined up without relying on the printing data. Therefore, transfer pixels are lined up at equal intervals in the central part of each pixel as shown in FIG. 5.

Figure 6:
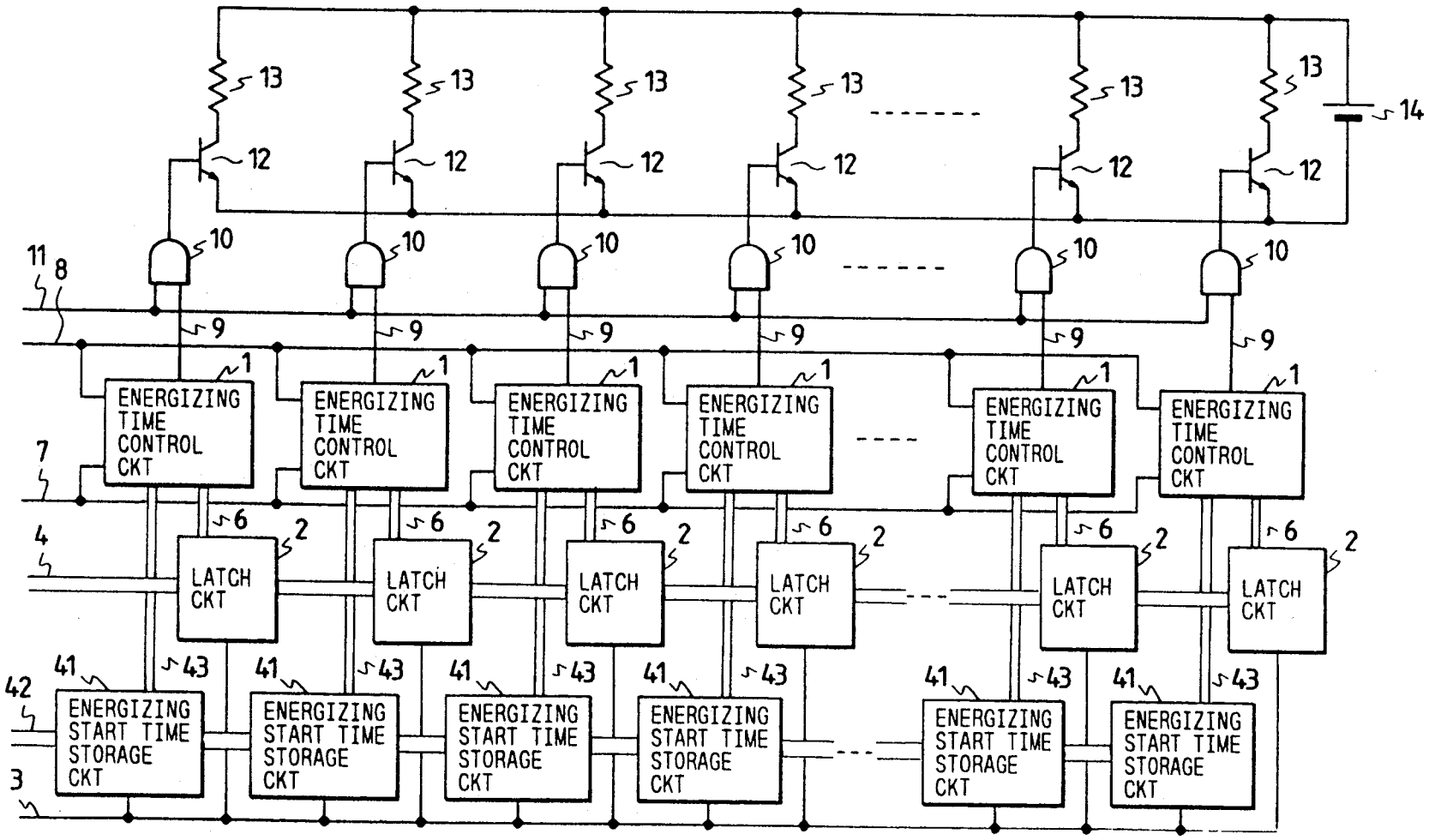
FIG. 6 is a block diagram illustrating a circuit for controlling the energizing of heating elements according to a second embodiment of the present invention.

FIG. 6 is a block diagram illustrating another circuit for controlling the energizing of heating elements according to a second embodiment of the present invention.

Figure 7:
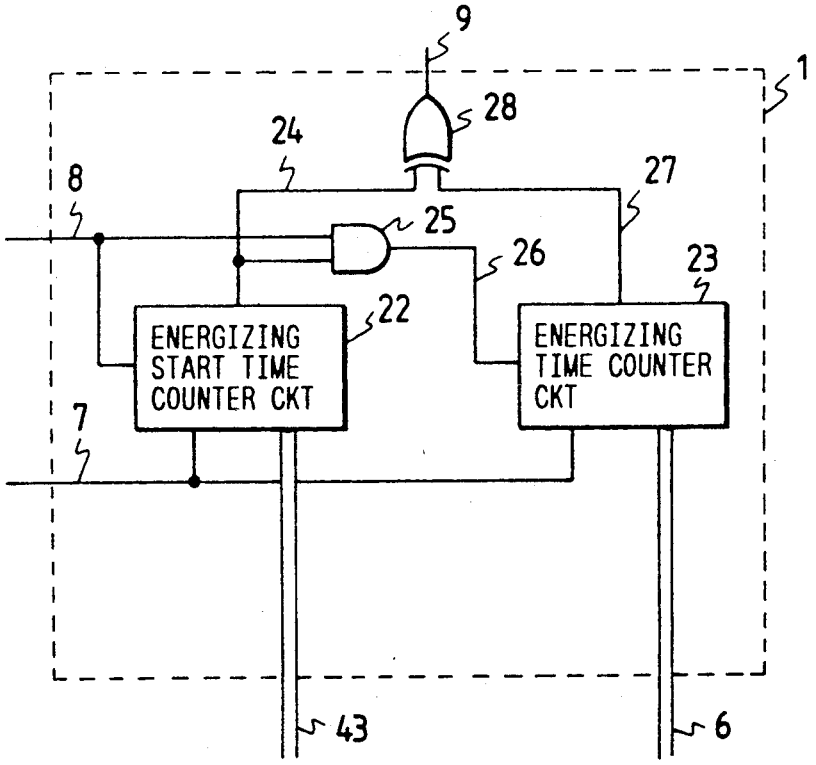
FIG. 7 is a block diagram illustrating in detail the energizing time control circuit in the second embodiment.
Figure 9:
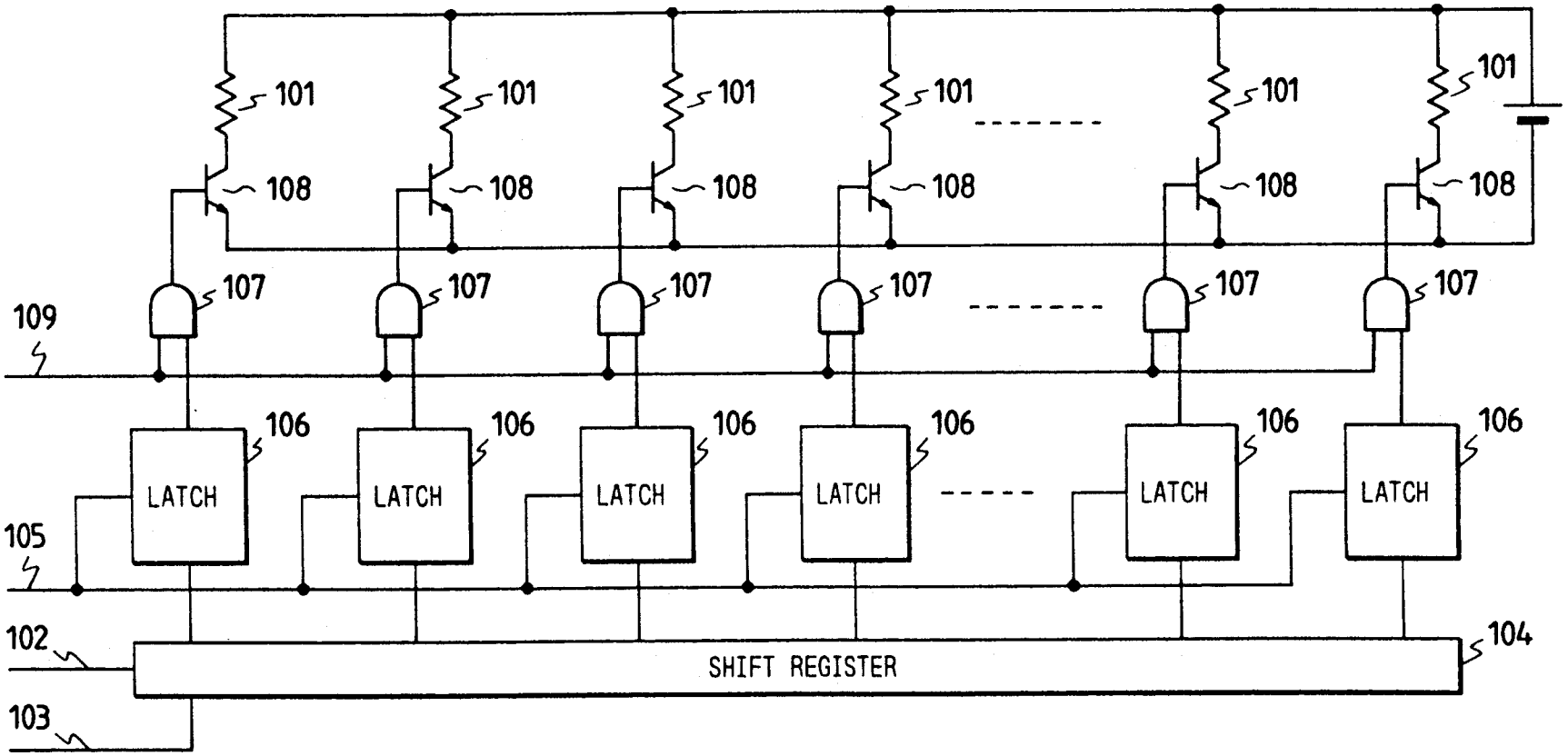
FIG. 9 is a block diagram illustrating a conventional circuit for controlling the energizing of heating elements.

Energizing start time storage circuits 41 are provided for storing a signal from an energizing start time signal line 42. The energizing start time storage circuits are of multi-stage construction and correspond in number to the heating elements. Output lines 43 of the energizing start time storage circuits 41 are directly connected to the respective energizing time control circuits 1. FIG. 7 illustrates the energizing time control circuit 1 in detail.

In this embodiment, the energizing start time obtained by calculation from printing data in the first embodiment can be designated pixel-to-pixel from external equipment. Before being transferred, the printing data and the energizing start time data, intended for individual heating elements 13, are input to the latch circuit 2, and are also input into the energizing start time storage Circuit 41 in synchronization with a transfer clock signal. (See FIG. 3 for timing).

When data transfer is completed, a latch signal 7 is input to the energizing time control circuits 1, similar to the first embodiment. Then the output value of the energizing start time storage circuit 41 is written to the energizing start time counter circuit 22, whereas the output value of the latch circuit 2 is written to the energizing time counter circuit 23.

The energizing start time counter circuit 22 then carries out the count operation in synchronization with the counter clock signal, and when the count changes to 0, the energizing start time counter circuit 22 stops its count operation and produces a "1" (HIGH) energizing start signal 24. When the energizing start signal 24 changes to "1" (HIGH), the AND gate 25 opens and the counter clock signal 8 is supplied to the energizing time counter circuit 23. The count operation is thus started. Simultaneously, the energizing signal line 9 changes to "1" (HIGH) and the heating element 13 is energized on condition that the protective gate signal line 11 stays at "1" (HIGH).

Subsequently, the energizing time counter circuit 23 stops its count operation when the count changes to 0 and makes the energizing signal 9 "0" (LOW), thus causing the energizing of the heating element 13 to be terminated. A series of operations as set forth above is performed to form images equivalent to one line.

According to the present invention, the energizing start time is set in inverse proportion to the size of dots to be formed so that printing can be made in such a way as to line up the centers of the dots uniformly on the same horizontal line, irrespective of the dot size. Consequently, the dots are uniformly shaped even when the pixel density in a multi-value data image is expressed by means of area modulation. In other words, an image free from density irregularity and moiré is obtained. Moreover, outlines can be made to appear smooth when characters, lines, circles using binary dots are drawn.

What is claimed is:

1. A circuit for controlling the energizing of heating elements, said circuit comprising:

a plurality of transistors for turning on or off respective ones of a plurality of heating elements mounted in alignment on a thermal printing head, a plurality of multi-bit latch circuits for storing energizing time values, a plurality of energizing time counter circuits for effecting counting operations in accordance with the energizing time values stored in respective ones of said latch circuits, and a plurality of energizing start time counter circuits for controlling a time until respective ones of said energizing time counter circuits start a timing operation, and a plurality of subtraction circuits for subtracting ½ of an energizing time value of a dot to be printed from ½ of the maximum printable energizing time, an output of said subtraction circuits being applied as an input to said energizing start time counter circuits.

2. A circuit for controlling the energizing of heating elements as claimed in claim 1, further comprising a plurality of multi-bit second latch circuits for storing energizing start times, wherein energizing start times that have been input to said second latch circuits from the outside are input to said energizing start time counter circuits.

3. A circuit for controlling the energizing of heating elements as claimed in claim 1, further comprising a plurality of AND gates supplied with output signals from respective ones of said energizing start time counter circuits and a signal from a clock, wherein outputs from said AND gates are input to respective ones of said energizing time counter circuits for controlling the energizing times of said heating elements.

4. A circuit for controlling the energizing of heating elements as claimed in claim 3, further comprising a plurality of exclusive-OR gates for outputting energizing time signals for energizing said heating elements based upon said outputs from said energizing start time counter circuits and outputs from said energizing time counter circuits.

* * * * *